US008684659B2

(12) United States Patent
Böck

(10) Patent No.: US 8,684,659 B2
(45) Date of Patent: Apr. 1, 2014

(54) ROTATING BLADE SYSTEM FOR A ROW OF ROTATING BLADES OF A TURBOMACHINE

(75) Inventor: Alexander Böck, Kottgeisering (DE)

(73) Assignee: MTU Aero Engines AG, Munich (DE)

( * ) Notice: Subject to any disclaimer, the term of this patent is extended or adjusted under 35 U.S.C. 154(b) by 431 days.

(21) Appl. No.: 13/059,367

(22) PCT Filed: Aug. 1, 2009

(86) PCT No.: PCT/DE2009/001094

§ 371 (c)(1),
(2), (4) Date: Feb. 16, 2011

(87) PCT Pub. No.: WO2010/020210

PCT Pub. Date: Feb. 25, 2010

(65) Prior Publication Data

US 2011/0142652 A1 Jun. 16, 2011

(30) Foreign Application Priority Data

Aug. 16, 2008 (DE) ..... 10 2008 038 038

(51) Int. Cl.
*F01D 5/02* (2006.01)

(52) U.S. Cl.
USPC ..... 415/1; 416/191; 416/203

(58) Field of Classification Search
USPC ..... 415/191, 192, 194, 195, 1; 416/191, 416/194, 203, 223 R, 223 A
See application file for complete search history.

(56) References Cited

U.S. PATENT DOCUMENTS

| | | | | |
|---|---|---|---|---|
| 5,211,540 | A * | 5/1993 | Evans | 416/190 |
| 2007/0183898 | A1 * | 8/2007 | Hurst et al. | 416/223 R |

FOREIGN PATENT DOCUMENTS

| | | | |
|---|---|---|---|
| EP | 0528138 | A1 | 2/1993 |
| EP | 1447525 | A1 | 8/2004 |
| GB | 2215407 | A | 9/1989 |
| WO | 2005026501 | A1 | 3/2005 |

OTHER PUBLICATIONS

PCT: International Search Report and Written Opinion of PCT/DE2009001094; Aug. 1, 2009; 7 pages.

PCT: International Search Report and Written Opinion of PCT/DE2009001094; Aug. 1, 2009; 13 pages.

* cited by examiner

*Primary Examiner* — Edward Look
*Assistant Examiner* — Maxime Adjagbe
(74) *Attorney, Agent, or Firm* — Howison & Arnott, L.L.P.

(57) ABSTRACT

The invention concerns a moving blade system for a moving blade sequence of a continuous-flow machine, in particular a thermal gas turbine with at least two moving blade segments, of which each moving blade segment encompasses at least two moving blades that are disposed, in reference to a rotation axis of the moving blade sequence, at least primarily radially between a radially interior and a radially exterior shroud band and are coupled to the shroud bands, wherein at least the radially exterior shroud bands of the two moving blade segments encompass contact surfaces that correspond to one another, wherein radial equilibrium axes of neighboring moving blades of the at least two moving blade segments are disposed in a tilted manner by respectively axially an angle ($\alpha_a$, $\alpha_b$) relative to their respective base inclination, wherein the angles ($\alpha_a$, $\alpha_b$) in regard to the base inclination feature opposite signs. The invention concerns furthermore a continuous-flow machine as well as a method for the mounting of a moving blade sequence for a continuous-flow machine.

16 Claims, 1 Drawing Sheet

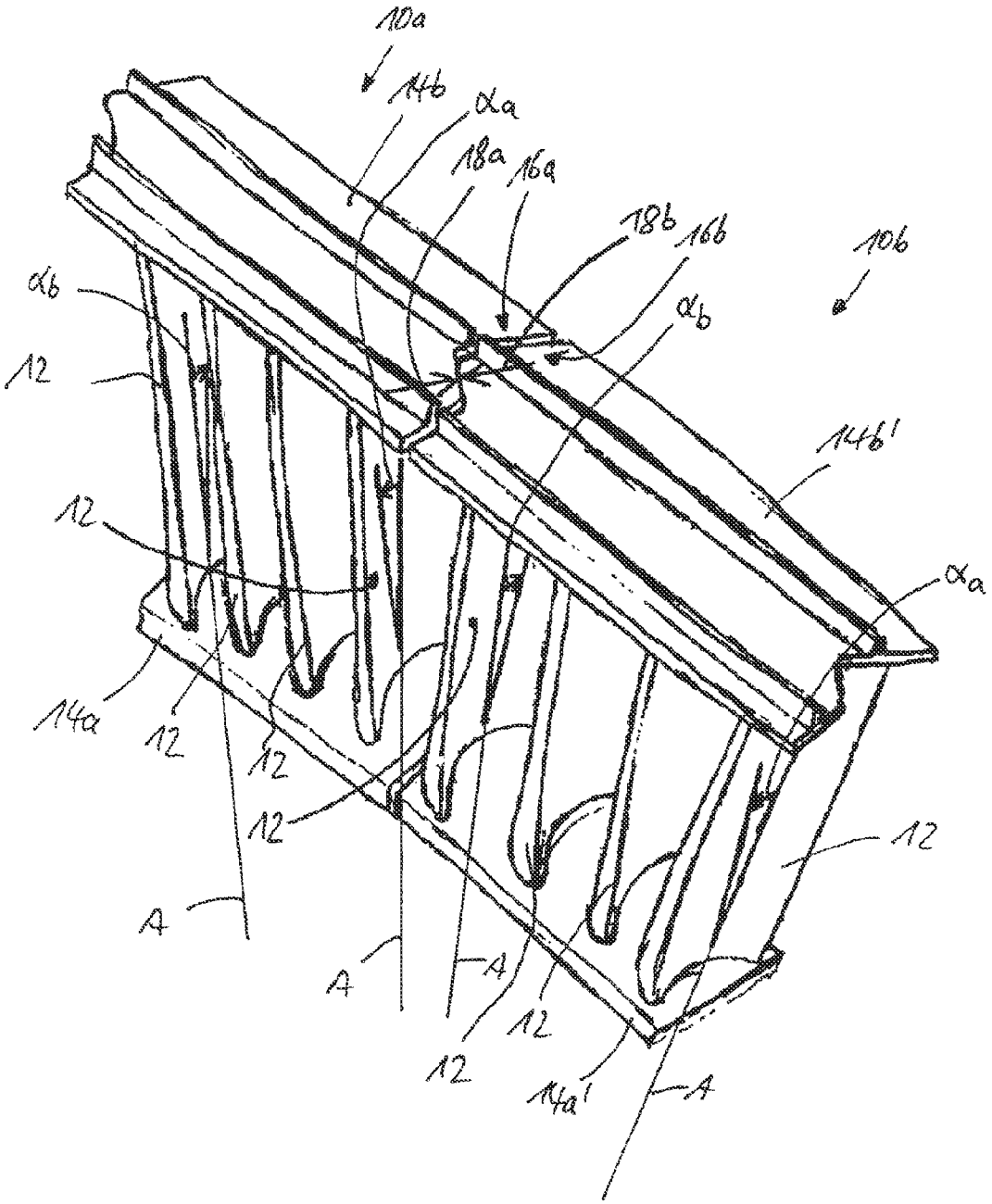
10a
14b
αa
18a
16a
18b
16b
10b
αb
αb
12
14b'
12
αa
14a
12
12
12
12
A
A
A
12
12
14a'
A

ROTATING BLADE SYSTEM FOR A ROW OF ROTATING BLADES OF A TURBOMACHINE

CROSS-REFERENCE TO RELATED APPLICATIONS

This application is a U.S. National Phase application submitted under 35 U.S.C. §371 of Patent Cooperation Treaty application serial no. PCT/DE2009/001094, filed Aug. 1, 2009, and entitled ROTATING BLADE SYSTEM FOR A ROW OF ROTATING BLADES OF A TURBOMACHINE, which application claims priority to German patent application serial no. 10 2008 038 038.5, filed Aug. 16, 2008, and entitled LAUFSCHAUFELSYSTEM FUR EINE LAUFSCHAUFELREIHE EINER STROMUNGSMASCHINE.

Patent Cooperation Treaty application serial no. PCT/DE2009/001094, published as WO 2010/020210, and German patent application serial no. 10 2008 038 038.5, are incorporated herein by reference.

TECHNICAL FIELD

The invention concerns a moving blade system for a moving blade sequence of a continuous-flow machine, e.g., a thermal gas turbine. The invention concerns furthermore a continuous-flow machine e.g., a thermal gas turbine, as well as a method for the mounting of a moving blade sequence for a continuous-flow machine.

BACKGROUND

A moving blade system for a moving blade sequence of a continuous-flow machine is already known from prior art. The moving blade system thereby encompasses two or more moving blade segments of which each moving blade segment features at least two moving blades that are disposed, in reference to a rotation axis of the moving blade sequence, at least primarily radially between a radially interior and a radially exterior shroud band and are coupled to the shroud bands. At least the radially exterior shroud bands of the moving blade segments encompass contact surfaces that correspond to one another and via which the moving blade segments abut against one another. With the aid of the moving blade segments (so-called cluster) the number of joints and gaps of the moving blade system can be significantly reduced in comparison to the moving blade systems made of individual moving blades. In addition there are fewer surfaces of engagement for the gases being guided through the associated continuous-flow machine, as a result of which the durability of such moving blade systems or moving blade sequences can be increased. Beyond that the moving blade segments form in the mounted state mechanically comparably stable units, whereby relative movements during operation and the wear and tear associated therewith are advantageously reduced.

The circumstance is however viewed as a disadvantage in the known moving blade systems that the moving blade segments, in contrast to moving blade systems made of individual moving blades, can no longer be braced by means of the torsion of the moving blades of a moving blade sequence against one another. As a result the moving blade segments are mechanically decoupled from one another and can only be controlled with difficulty from an oscillation-mechanics related point of view.

SUMMARY AND DESCRIPTION

It is therefore the object of the invention at issue to create a moving blade system of the kind referred to initially that features improved oscillation-mechanics related properties.

The aforesaid problem is addressed according to the invention by means of a moving blade system with the characteristics described herein, a continuous-flow machine with the characteristics 7 described herein, as well as by means of a method according to patent claim 9. Advantageous embodiments with suitable improvements of the invention are also specified herein, wherein advantageous embodiments of the moving blade system or the continuous-flow machine—to the extent that they are applicable—are to be viewed as advantageous embodiments of the method and the reverse.

A moving blade system for a moving blade sequence of a continuous-flow machine according to one embodiment of the invention, which features improved oscillation-mechanics related properties, is created due to the fact that radial equilibrium axes of neighboring moving blades of the at least two moving blade segments are disposed in a manner respectively axially tilted by an angle relative to their respective base inclination, wherein the angles feature opposite signs in regard to the base inclination. In other words it is provided that neighboring moving blades of the at least two moving blade segments are disposed in a scissor-like tilted manner, originating from the respective base inclination. The base inclination, which is also referred to as "lean", commonly serves the purpose of largely balancing the gas forces that arise during the operation of the associated continuous-flow machine and that generate corresponding bending moments on the moving blades, at least in certain operation areas of the continuous-flow machine. The base inclination, by which the equilibrium axes of the moving blades are disposed in a tilted manner, is thereby commonly between 0° and 2°, depending on the implementation of the continuous-flow machine. The equilibrium axis can thereby, depending on the geometries of the moving blades, run coaxially or axis-parallel to the thread-on axis of the moving blade profile.

With the aid of the arrangement according to the invention of the neighboring moving blades a shift of the center of gravity is therefore achieved in particular in the area of the contact surfaces of the radially exterior shroud bands. Due to the centrifugal forces that arise during the operation of the associated continuous-flow machine, contact forces that are dependent on the number of revolutions between the at least two moving blade segments can thereby be generated by constructively simple means that lead to an improved mechanical coupling of the moving blade segments and the corresponding improvement of the oscillation-mechanics related properties.

Since the angles, by which the radial equilibrium axes are disposed in a tilted manner relative to their respective base inclination, are equal in amount, contact forces that are correspondingly equal in amount and directed in opposite direction to one another are generated on the contact surfaces of the moving blade segments during the operation of the moving blade system. As a result the generation of undesired bending moments between the moving blade segments can be reliably prevented.

Additional advantages arise by implementing the moving blades of at least one moving blade segments integrally with the interior shroud band and/or with the exterior shroud band. Hereby a significant reduction of the manufacturing costs are achieved due to the lower number of construction components.

In an additional advantageous embodiment of the invention provision is made that the moving blades are cast into the interior shroud band and/or into the exterior shroud band. This makes possible by cost-efficient means a mechanically stable and operationally secure linking of the moving blades with the respective shroud band.

Additional advantages arise if the contact surfaces are implemented as a mechanical latching. By these means the contact forces that are achievable with the aid of the moving blade system according to the invention can be distributed two-dimensionally so that in contrast to prior art no elastic deformations arise, but instead the forces being generated in the area of the contact surfaces are disposed of as contact forces. By these means a mechanically particularly stable coupling of the at least two moving blade segments is achieved, so that the moving blade system is oscillation-mechanics related in a non-critical state.

In a further advantageous embodiment of the invention provision is made that the value of the angles is between 0.1° and 10°, in particular between 0.1° and 5° and preferably between 0.1° and 2°. This permits on the one hand an advantageous adaptability to the moving blades or continuous-flow machines that are implemented differently and makes possible in addition a precise shift of the center of gravity with correspondingly specifically adaptable centrifugal forces during the operation.

A further aspect of the invention concerns a continuous-flow machine, in particular a thermal gas turbine with a moving blade sequence that encompasses a moving blade system of at least two moving blade segments, of which each moving blade segment features at least two moving blades that are disposed, in reference to a rotation axis of the moving blade sequence, at least primarily radially between a radially interior and a radially exterior shroud band and are coupled to the shroud bands, wherein at least the exterior shroud bands of the two moving blade segments encompass application areas that correspond to one another, via which the moving blade segments are coupled to one another. In order to achieve improved oscillation-mechanics related properties, provision is made according to the invention that radial equilibrium axes of neighboring moving blades of the at least two moving blade segments are tilted respectively axially by an angle relative to their respective base inclination, wherein the angles feature opposite signs in regard to the base inclination. By these means a specific shift of the center of gravity of the moving blades is achieved so that during the operation of the moving blade sequence or the continuous-flow machine an erecting force acting on the neighboring moving blades arises that leads to a mechanically stable and, oscillation-mechanics related, non-critical coupling of the linking areas and thereby of the at least two moving blade segments.

Additional advantages arise because the moving blade system of the moving blade sequence is implemented according to one of the previous embodiment examples. The advantages that arise there from can be deduced from the corresponding descriptions of the advantages.

In an additional advantageous embodiment of the invention provision is made that the moving blades sequence is disposed in a turbine area, particularly in a low-pressure turbine area of the continuous-flow machine. It is thereby possible to provide the continuous-flow machine with few moving blade sequences, whereby significant weight- and cost-savings arise. Due to the coupling of the moving blades with the shroud bands on the one hand and the coupling of the at least two moving blade segments with one another on the other, the number of joints and gaps in the moving blade sequence is reduced, whereby possible streaming losses are correspondingly reduced. In addition fewer surfaces of engagement present themselves to the aggressive hot gases that arise in the turbine area, whereby the durability of the moving blade sequence and the continuous-flow machine as a whole is increased.

A further aspect of the invention concerns a method for the mounting of a moving blade sequence for a continuous-flow machine, in particular for a thermal gas turbine in the case of which at least two moving blade segments of a moving blade system are provided according to one of the previous embodiment examples and those moving blades of the at least two moving blade segments, which are respectively tilted axially by an angle ($\alpha_a$, $\alpha_b$) relative to their respective base inclination, are disposed in an adjacent manner to each other, wherein the angles in regard to the base inclination of the moving blades feature opposite signs. This permits a mechanically stable and oscillation-mechanics related non-critical mounting of the moving blade sequence, whereby a significant reduction of the manufacturing costs with at the same time increased durability is provided. An additional advantage is in the fact that the bracing contact forces between the moving blade segments only appear, depending on the number of revolutions, during the operation of the continuous-flow machine so that the moving blade segments are particularly easily mounted or dismantled during standstill.

Additional advantages arise when the linking areas of the moving blade segments are coupled with one another in a deformation-free manner. In contrast to prior art, whereby because of the torsion of the blade profiles relative to the shroud bands the contact force at the linking areas has to be generated by means of elastic deformation and also acts during standstill, it is possible to achieve with the aid of the method according to the invention and the shift of the center of gravity of the moving blades during the operation a pre-tension and thereby an oscillation-mechanics related non-critical coupling of the at least two moving blade segments also without deformation.

BRIEF DESCRIPTION OF THE DRAWING

Further advantages, characteristics, and details of the invention are specified in the following description of an embodiment example as well as from the drawing.

FIG. 1 shows a schematic perspective view of two moving blade segments of a moving blade system for a moving blade sequence that are coupled to one another for disposition in a low-pressure turbine area of a thermal gas turbine

DETAILED DESCRIPTION

FIG. 1 shows a schematic perspective view of two moving blade segments 10*a*, 10*b* that are coupled to one another of a moving blade system that is implemented with a plurality of moving blade segments 10 for a moving blade sequence for the purpose of disposition in a low-pressure turbine area of a thermal gas turbine (not represented). Each moving blade segment 10*a*, 10*b* encompasses in the present embodiment example respectively four moving blades 12 (airfoils) that are disposed, in reference to a rotation axis of the moving blade sequence that is mounted in the continuous-flow machine, primarily radially between a radially interior shroud band 14*a*, 14*a*' and a radially exterior shroud band 14*b*, 14*b*' and are coupled to the shroud bands 14*a*, 14*b* or 14*a*', 14*b*'. The radially exterior shroud bands 14*b*, 14*b*' of the two moving blade segments 10*a*, 10*b* encompass contact surfaces 16*a*, 16*b* that are implemented in a manner corresponding to one another, with a Z-shaped course (so-called Z-shroud). The contact surfaces 16*a*, 16*b*, which are disposed at an angle to one another, are thereby implemented as a mechanical linkage. The moving blades 12 are cast respectively in the interior and exterior shroud bands 14*a*, 14*a*', 14*b*, 14*b*' in order to achieve a mechanically stable connection with the low weight. Since the moving blade segments 10*a,* 10*b* (so-called cluster) that encompass the several moving blades 12 can, in contrast to individual moving blades 12, no longer be braced by means of torsion relative to the shroud bands 14*a,* 14*a*', 14*b,* 14*b*' against one another, the required contact force between the contact surfaces 16*a,* 16*b* is generated during the operation of the associated continuous-flow machine due to the fact that the radial equilibrium axes A of neighboring moving blades 12 of the at least two moving blade segments 10*a,* 10*b* are disposed in a tilted manner by respectively axially an angle $\alpha_a$, $\alpha_b$ relative to the respective base inclination (so-called lean). The angles $\alpha_a$, $\alpha_b$ are thereby selected in such a manner that neighboring moving blades 12 are tilted in a scissor-like manner relative to their respective base inclination by angles $\alpha_a$ or $\alpha_b$ that are oppositely oriented but equal in value. In other words, a moving blade 12 is tilted backwards relative to the lean in reference to a rotation axis of the moving blade system and the neighboring moving blade 12 is correspondingly tilted to the front. By these means a shift of the center of gravity of the moving blades 12 that are considered is achieved, whereby due to the centrifugal forces during the operation of the associated continuous-flow machine erecting forces, which are dependent on the number of revolutions, are created that dispose themselves according to the arrows 18*a,* 18*b* on the contact surfaces 16*a,* 16*b* as contact forces. By these means the moving blade segments 10*a,* 10*b* are mechanically coupled during the operation so that the entire moving blade system or the moving blade sequence is oscillation-mechanics related in a non-critical state. The contact forces increase thereby with the number of revolutions. On the other hand, no contact force acts between the moving blade segments 10*a,* 10*b* during standstill, as a result of which they are correspondingly easily mounted and dismantled. The angles $\alpha_a$, $\alpha_b$ in the presented embodiment example are thereby about ±1°. Fundamentally however deviating angles $\alpha$ or angles that are of differing values $\alpha_a$, $\alpha_b$ can be selected. It is preferably provided that the marginal moving blades 12 of each moving blade segment 10 are likewise tilted relative to their respective base inclination by angles $\alpha$ that oppose one another. Alternatively or additionally provision can be made that the interior moving blades 12 of the respective moving blade segments 10 are tilted relative to their respective base inclination by an angle $\alpha$.

The invention claimed is:

1. A moving blade system for a moving blade sequence in a continuous flow machine, the moving blade sequence defining a rotation axis, the moving blade system comprising:

at least two moving blade segments, each of which moving blade segment includes a radially interior shroud band, a radially exterior shroud band, and at least two moving blades, each of which moving blade disposed, in reference to the rotation axis of the moving blade sequence, at least primarily radially between the radially interior shroud band and the radially exterior shroud band, and coupled between the radially interior shroud band and the radially exterior shroud band, and having a radial equilibrium axis and a base inclination;

wherein at least the radially exterior shroud bands of the two moving blade segments include contact surfaces that correspond to one another;

wherein the radial equilibrium axis of a first end-most moving blade on a first end of a moving blade segment is tilted axially at a first angle in a first direction relative to the base inclination and the radial equilibrium axis of a second end-most moving blade on a second end of an adjacent moving blade segment is tilted axially at a second angle in a second direction opposite the first direction relative to the base inclination; and wherein the axial tilt of the first end-most moving blade and the second end-most moving blade cause a shift of a center of gravity of the at least two moving blade segments during rotation of the at least two moving blade segments, the shift of the center of gravity causing the corresponding contact surfaces of the at least two moving blade segments to mechanically couple during rotation of the at least two moving blade segments.

2. A moving blade system according to claim 1, wherein the the first angle and the second angle are equal in magnitude.

3. A moving blade system according to claim 1, wherein the moving blades of at least one moving blade segment are formed integrally with at least one of the interior shroud band and the exterior shroud band.

4. A moving blade system according to claim 1, wherein the moving blades are cast as part of at least one of the interior shroud band and the exterior shroud band.

5. A moving blade system according to claim 1, wherein the contact surfaces of the radially exterior shroud bands are implemented as mechanical linkage.

6. A moving blade system according to claim 1, wherein the magnitude of the first angle and the second angle is between 0.1° and 10°.

7. A moving blade system according to claim 6, wherein the magnitude of the first angle and the second angle is between 0.1° and 5°.

8. A moving blade system according to claim 7, wherein the magnitude of the first angle and the second angle is between 0.1° and 2°.

9. A moving blade system according to claim 1, wherein the continuous-flow machine is a thermal gas turbine.

10. A continuous-flow machine comprising:

a moving blade sequence defining a rotation axis and including a moving blade assembly;

the moving blade assembly having at least two moving blade segments, each of which moving blade segment includes a radially interior shroud band, a radially exterior shroud band, and at least two moving blades, each of which moving blade disposed, in reference to the rotation axis of the moving blade sequence, at least primarily radially between the radially interior shroud band and the radially exterior shroud band, and coupled between the radially interior shroud band and the radially exterior shroud band, and having a radial equilibrium axis and a base inclination;

wherein at least the radially exterior shroud bands of the two moving blade segments include contact surfaces that correspond to one another;

wherein the radial equilibrium axis of a first end-most moving blade on a first end of a moving blade segment is tilted axially at a first angle in a first direction relative to the base inclination and the radial equilibrium axis of a second end-most moving blade on a second end of an adjacent moving blade segment is tilted axially at a second angle in a second direction opposite the first direction relative to the base inclination; and wherein the axial tilt of the first end-most moving blade and the second end-most moving blade cause a shift of a center of gravity of the at least two moving blade segments during rotation of the at least two moving blade segments, the shift of the center of gravity causing the corresponding contact surfaces of the at least two moving blade segments to mechanically couple during rotation of the at least two moving blade segments.

11. A continuous-flow machine according to claim 10, wherein the continuous-flow machine is a thermal gas turbine.

12. A continuous-flow machine according to claim 11, wherein the moving blades sequence is disposed in a turbine area of the continuous-flow machine.

13. A continuous-flow machine according to claim 12, wherein the moving blades sequence is disposed in a low-pressure turbine area of the continuous-flow machine.

14. A continuous-flow machine according to claim 10, wherein the magnitude of the first angle and the second angle is between 0.1° and 10°.

15. A method for the mounting of a moving blade sequence for a continuous-flow machine, the method comprising the following steps:

providing a moving blade assembly including at least two moving blade segments, each of which moving blade segment includes a radially interior shroud band, a radially exterior shroud band, and at least two moving blades, each of which moving blade disposed, in reference to the rotation axis of the moving blade sequence, at least primarily radially between the radially interior shroud band and the radially exterior shroud band, and coupled between the radially interior shroud band and the radially exterior shroud band, and having a radial equilibrium axis and a base inclination;

wherein at least the radially exterior shroud bands of the two moving blade segments include contact surfaces that correspond to one another;

wherein the radial equilibrium axis of a first end-most moving blade on a first end of a moving blade segment is tilted axially at a first angle in a first direction relative to the base inclination and the radial equilibrium axis of a second end-most moving blade on a second end of an adjacent moving blade segment is tilted axially at a second angle in a second direction opposite the first direction relative to the base inclination;

wherein the axial tilt of the first end-most moving blade and the second end-most moving blade cause a shift of a center of gravity of the at least two moving blade segments during rotation of the at least two moving blade segments, the shift of the center of gravity causing the corresponding contact surfaces of the at least two moving blade segments to mechanically couple during rotation of the at least two moving blade segments; and rotating the moving blade assembly until centrifugal forces arise to cause revolution-dependent contact forces between the contact surfaces of the radially exterior shroud bands of at least two moving blade segments, which forces are directed towards one another so as to couple the respective moving blade segments.

16. A method according to claim 15, wherein the moving blade segments are coupled with one another in a deformation-free manner.

* * * * *